US008561564B2

(12) United States Patent
Brenner et al.

(10) Patent No.: US 8,561,564 B2
(45) Date of Patent: Oct. 22, 2013

(54) DEVICE AND METHOD FOR LAUNCHING AN UNDERWATER MOVING BODY

(75) Inventors: Axel Brenner, Bremen (DE); Ralf Bartholomäus, Wedel (DE); Wolfgang Bünsch, Hamburg (DE); Sönke Huckfeldt, Elmshorn (DE); Dirk Fuhrmann, Wedel (DE)

(73) Assignee: Atlas Elektronik GmbH, Bremen (DE)

( * ) Notice: Subject to any disclaimer, the term of this patent is extended or adjusted under 35 U.S.C. 154(b) by 47 days.

(21) Appl. No.: 13/265,170

(22) PCT Filed: Apr. 22, 2010

(86) PCT No.: PCT/EP2010/055376

§ 371 (c)(1),
(2), (4) Date: Dec. 9, 2011

(87) PCT Pub. No.: WO2010/124990

PCT Pub. Date: Nov. 4, 2010

(65) Prior Publication Data

US 2013/0011196 A1 Jan. 10, 2013

(30) Foreign Application Priority Data

Apr. 30, 2009 (DE) ..... 10 2009 019 556

(51) Int. Cl.
*B63B 1/00* (2006.01)

(52) U.S. Cl.
USPC ..... 114/238; 114/239; 114/259; 89/1.809; 89/1.81; 89/1.11

(58) Field of Classification Search
USPC ..... 114/238, 239, 259; 89/1.809, 1.81, 1.11
See application file for complete search history.

(56) References Cited

U.S. PATENT DOCUMENTS

| | | | | |
|---|---|---|---|---|
| 624,472 | A | 5/1899 | Finlayson | |
| 4,444,087 | A | 4/1984 | Hunter et al. | |
| 4,465,012 | A * | 8/1984 | Bos | 114/266 |
| 5,253,605 | A * | 10/1993 | Collins | 114/259 |
| 5,542,333 | A * | 8/1996 | Hagelberg et al. | 89/1.81 |
| 7,712,429 | B1 * | 5/2010 | Gibson et al. | 114/312 |
| 2012/0037059 | A1 * | 2/2012 | Brenner | 114/21.2 |

FOREIGN PATENT DOCUMENTS

| | | |
|---|---|---|
| GB | 437846 | 11/1935 |
| JP | 04080600 A | 3/1992 |
| WO | 2009002391 A1 | 12/2008 |

OTHER PUBLICATIONS

"Standard Flex 300; The True Multi-Role Ship"; Mar. 1, 1992; pp. 1-15, Danyard, Denmark.

Palmerston Forts Society; "The Brennen Torpedo, The World's First Guided Weapon"; http://www.palmerstonforts.org.uk/brennan.htm.

Alec Beanse, "The Brennan Torpedo: The History and Operation of the Worlds first Practicable Guided Weapon," Palmerston Forts Society, Jul. 5, 1997; pp. 1-3, United Kingdom.

* cited by examiner

*Primary Examiner* — J. Woodrow Eldred

(74) *Attorney, Agent, or Firm* — Fitch, Even, Tabin & Flannery, LLP

(57) ABSTRACT

A method and a device for launching an underwater moving body. In order to reduce the expenses arising from furnishing watercraft, a land supported deployment of underwater moving bodies in coastal waters using a launching device is provided with a land-based carrier system for transporting the underwater moving body and a corresponding land-based deploying system.

13 Claims, 9 Drawing Sheets

DEVICE AND METHOD FOR LAUNCHING AN UNDERWATER MOVING BODY

CROSS REFERENCE TO RELATED APPLICATION

This application is the National Stage filing under 35 U.S.C. 371 of International Application No. PCT/EP2010/055376, filed Apr. 22, 2010, and claims priority of German Patent Application No. 10 2009 019 556.4 filed Apr. 30, 2009, the subject matter of which in its entirety, is incorporated herein by reference

BACKGROUND OF THE INVENTION

The invention relates to a launching apparatus for launching an underwater moving body, and to a corresponding method, in which an underwater moving body is launched by means of a launching apparatus such as this.

Underwater moving bodies are conventionally launched from surface vessels or underwater vessels. The watercraft required for this purpose and the maintenance thereof are, however, extremely costly.

The invention is therefore based on the problem of launching underwater moving bodies significantly more cost-effectively.

The invention solves this problem by means of a launching apparatus for launching an underwater moving body which has a land-based carrier system, in particular a carrier system which can be moved on land, for transporting the underwater moving body, and a deployment system for land-based deployment of the underwater moving body into a coastal waterway, wherein the carrier system has the deployment system or the carrier system and the deployment system are provided separately from one another.

Furthermore, the invention solves this problem by means of a method for launching an underwater moving body using a launching apparatus such as this, wherein the underwater moving body is transported to a launch position in a land-based carrier system, in particular a carrier system which can be moved on land, and is deployed from the land by means of a deployment system, for example from the carrier system, into a coastal waterway, and is launched from the launch position there.

The invention is based on the knowledge that underwater moving bodies need not necessarily be launched from an offshore platform, and instead this is also possible by means of a land-based system. For this purpose, the invention provides a land-based deployment system, by means of which underwater moving bodies can be deployed into the water directly from the land, and can be launched there. This renders offshore platforms superfluous, as a result of which there is no need to use costly surface vessels or underwater vessels.

Overall, the invention therefore allows a significantly more cost-effective system for launching underwater moving bodies which, furthermore, can be used very flexibly because of its mobility.

In one particular embodiment, the carrier system is a container, in particular a container which can be moved on land. In a further embodiment, the carrier system is a vehicle having a container, in particular an articulated truck.

The launching apparatus according to the invention therefore provides a carrier system which is preferably a trailer for transporting the container. Alternatively, however, the container can be firmly connected to a chassis.

The container is advantageously a forty-foot container with the conventional maritime trade dimensions. Containers such as this have a length of 12.19 m, a width of 2.44 m and a height of 2.60 m. The container is therefore preferably designed in accordance with ISO 668. This is advantageous since a container such as this can be loaded onto marine vessels or onto goods vehicles and trailers for holding such standard containers, using normal loading facilities. This simplifies the handling of such containers and reduces the costs incurred for production and use.

One particular embodiment of the container is a hazardous-goods container, in particular a modified tank for transporting liquids. In consequence, the transport for the underwater moving body is declared to be hazardous goods but, because of the casing of the container, cannot be identified as an underwater moving body transport. Furthermore, because of the enhanced safety requirements for hazardous goods containers, the underwater moving bodies are transported in a protected manner, and have particular protection in the event of accidents.

In a further embodiment, the carrier system is a vehicle, in particular a vehicle which is designed to transport loads, in particular a vehicle having a closable or open loading surface without or without a cover, in particular a tarpaulin. The carrier system is therefore advantageously a small goods vehicle, a small transporter, a box truck, a delivery truck or a flatbed truck.

A further specific embodiment of the carrier system is a vehicle having one or more connected trailers with or without containers, in particular a truck, a two-axle or multiple-axle articulated truck, a three-axle or multiple-axle semi-trailer or a multiple-axle articulated train. Vehicles such as these are, in particular, multiple-unit trains, EuroCombi or road trains. The trailers have unsteered axles or, alternatively, one or more steered axles. This is advantageous because a plurality of underwater moving bodies can be transported at the same time, and the load placed on each axle from the weight of the underwater moving bodies can be reduced.

One alternative embodiment of the carrier system is a rail vehicle having one or more cars, in particular a railroad car in the form of a freight car or passenger car, with or without their own drive. This allows rail traffic to also reach locations on coastal waterways. This advantageously reduces the transport costs if rails have already been laid in the area of coastal waterways, for example as is the case in port-to-port installations.

These embodiments of the carrier system are particularly advantageous because a carrier system with appropriate dimensions can be selected on the basis of size, weight and number of the deployment systems and/or of the underwater moving bodies, in order to minimize the costs incurred.

The carrier system preferably has a visually deceiving camouflage device, in particular a visual dune simulation, rock simulation or camouflage cover, for example a camouflage tent or a desert sand camouflage device. The visual deception advantageously comprises the simulation of naturally occurring geographic characteristics, in particular dunes, rocks or hills. The surface structure of the simulation can advantageously have added to it typical objects from the launching environment, such as plants or stones, in particular grass, shrubs or sand.

The camouflage device is preferably of the same color and/or pattern as the launch environment. The "launch environment" should be understood as meaning the environment in which the carrier system is located for launching one of the underwater moving bodies. These embodiments are particularly advantageous because they reduce the probability of identification and therefore also of location of the carrier systems.

The deployment system preferably has a cantilever arm which can be extended on or from the carrier system, a trolley and a cable, wherein the trolley can be moved on the cantilever arm and the cable can be connected indirectly or directly to the underwater moving body at a first of its two ends, and is guided via the trolley, and is connected at its second end to a drive, by means of which, when the cantilever arm is extended and the trolley has been moved to an outer limit position on the cantilever arm, the underwater moving body can be let into the water. The trolley and the movable cantilever arm can therefore be used to move the underwater moving body out of the carrier system, to let it essentially vertically into the water above the waterway, and then to launch it.

This embodiment is particularly advantageous because controlled deployment of the underwater moving body into the water is ensured even in shallow waterways. The underwater moving body can itself be launched in a shallow water depth, since it can be accelerated from a stationary, resting horizontal position. This is made possible by the underwater moving body being lowered substantially vertically, guided on a cable, to a predetermined water depth.

In a further preferred embodiment, the deployment system has a cage for holding the underwater moving body, wherein the first end of the cable can be connected to the cage. Because of a cage such as this, the underwater moving body does not require an unlatching device in order to separate it from the cable, as would be necessary in the case of an alternative direct attachment of the cable to the underwater moving body. However, this would first of all lead to sinking, and therefore to vertically directed acceleration of the underwater moving body. However, because of the cage, the underwater moving body can be accelerated horizontally out of the cage.

The configuration as a cage, that is to say with only a small number of struts which surround the underwater moving body, is particularly advantageous because no air need be displaced when the underwater moving body is placed in the water, as would be the case, for example, with a tubular container. Furthermore, there is also essentially no recoil on the cage when the underwater moving body is launched, which would lead to uncontrollable movements of the cage and would therefore make it more difficult to launch the underwater moving body horizontally. The use of a cage is therefore also advantageous in terms of the required water depth. Specifically, if an underwater moving body with a running propeller were first of all to start dynamically moving downward because of an inclination, a substantially deeper water depth would be required for launching. Because the cage assists the process of aligning the underwater moving body horizontally for launching, shallow water depths are also sufficient, however, in order to launch the underwater moving body.

As an alternative to the cage, a tubular container is provided, in particular a tube having at least one opening. In this way, the force distribution when the underwater moving body is in place is not only restricted to individual struts of the cage, but is distributed over the entire surface of the tubular container on which it rests. In one specific embodiment, the tubular container has only one opening, which is located in the direction in which the underwater moving body leaves, and has at least the same diameter as the underwater moving body. Recoil when the underwater moving body is launched is therefore forced through the container. This is advantageous because the underwater moving body is therefore provided with greater forward propulsion during launching. After having been deployed into the water, a tubular container such as this is advantageously fixed by cables, by means of clamping appliances, in particular hooks or wedges, in such a way that the recoil forces are counteracted. The clamping appliances are fitted, in the direction of the opening of the container, to at least two mutually opposite points, which are located relative to the longitudinal axis of the container. This simplifies controlled launching of the underwater moving body despite the recoil.

In a further specific embodiment, the tubular container has more than one opening, in particular a perforation, as a result of which air which is located in the container can escape when the container is immersed in the water. This is advantageous since the air can otherwise result in buoyancy, and therefore in an uncontrolled change in the attitude under the water. The existence of more than one opening, in particular an opening provided at the rear end of the container, reduces the recoil when the underwater moving body is launched, thus making it possible to dispense with fixing by means of clamping apparatuses.

In a further special embodiment, the cantilever arm is in the form of a telescopic cantilever arm with a plurality of telescopic segments. A telescopic cantilever arm such as this allows longer cantilever-arm ranges and therefore a launch position which is further away from the shore, where greater water depths can be expected. The options for use of the launching apparatus are extended in this way, since this also allows the underwater moving body to be deployed into the water even where the shore falls away only gradually.

In a further special embodiment, the container has a counterweight which is arranged in the area of the end of the container and is opposite a possibly closable opening, in particular at the rear, out of which the cantilever arm can be moved. This embodiment is advantageous in terms of longer cantilever-arm ranges, which have a tendency to cause a greater tilting torque on the container with the risk of the container tilting about a rear lower edge of the container or about a (rear) axle of a trailer which is carrying the container. The counterweight makes it possible to counteract a tilting torque such as this. The counterweight therefore allows longer cantilever-arm ranges. As already stated above, this leads, however, to an extended field of use since the greater range allows deployment of an underwater moving body in waterways which fall away only gradually, since greater water depths can be reached because of the longer cantilever-arm range.

The cantilever arm is advantageously fitted in the upper area of the container. The space below the cantilever arm therefore remains free for storage of a plurality of underwater moving bodies. This allows a multiplicity of underwater moving bodies to be accommodated without problems in a single container.

In a further embodiment, the deployment system has a sliding device which can be lengthened starting under an underwater moving body, which is located in the container, or connected to a cage which holds the underwater moving body extending or inclined downward, via a closable opening, in particular at the rear, of the container. This allows an underwater moving body to be deployed into the water by sliding, and then launched. The underwater moving body for this purpose requires only a suitable sliding path, which is advantageously in the form of a groove. This sliding path starts in the container below the underwater moving body or adjacent to said cage and has one or more sections outside the container added to it in the course of the launching preparations. This allows the deployment system to also be used on beaches or muddy stretches of coast where it is not possible to drive on the area directly adjacent to the shore.

The sliding device therefore advantageously has a plurality of sliding lengthening segments which can be connected to one another. This allows the slide to be lengthened such that it is also possible to reach greater water depths, in which the underwater moving body can be launched without any problems, and without the risk of damage on the bottom of the waterway.

In a further advantageous embodiment, the deployment system has a cage for holding the underwater moving body, wherein this cage can be pivoted to a vertical plane by means of a drive about a pivoting shaft which is provided in the area of the container opening. As a result of this cage being pivoted, the underwater moving body starts to slide from a predetermined inclination angle, as a result of which it enters the water via the sliding device. The underwater moving body is therefore released by pivoting the cage.

In a further special embodiment, the deployment system has a catapult by means of which the underwater moving body is fired out of the carrying system, in particular a spring system which can be stressed. This makes it possible to increase the distance from the carrier system to the coastal waterway, depending on the firing force of the catapult.

The spring system which can be stressed preferably has elastic tension cables and a stressing apparatus. The underwater moving body has a holder for the elastic tension cables, which holder is designed such that it releases the tension cable as soon as the tension cable is in the opposite direction to the stressed pulling direction. The holder cannot be seen, because of a spring-operated flap, when the tension cable is not connected. This is advantageous because the dynamic characteristics of the underwater moving body in the water are not adversely affected by this.

The attachment points for the tension cable in the rails are advantageously movable. These rails of the deployment system are mounted in a fixed position on the carrier system, in particular in the corners of the container. The rails have not only guide rollers but also attachment points for the tension cable. The tension cable is connected from the attachment point via the guide roller to the holder for the underwater moving body. This allows the tension cable to be stressed by shortening the tension cable, in particular by means of a winch, or by lengthening the distance to the guide roller on the rail via a telescopic rail. This allows the underwater moving body to be placed in the prestressed initial position on the catapult, but without tensile forces being formed in the ejection direction. The underwater moving body which has been prestressed in this way can be connected to an attachment apparatus for the cassette on the carrier system. This provides the restraint in the catapult until the release mechanism releases the tensile forces of the tension cables. The tensile forces are increased by a stretching tension cables which are passed over guide rollers, in particular via a winch to the attachment points of the tension cable. Alternatively, the tension cable is stressed via extendable telescopic rails wherein the telescopic rail has a guide roller at the end, over which guide roller the tension cable runs.

One specific embodiment of the deployment system has two or more tension cables per rail. The holders are advantageously fitted to the underwater moving body in front of and behind the center of gravity of the underwater moving body. The alignment of the underwater moving body can therefore be controlled by the process of stressing the catapult. This predetermines the flightpath of the underwater moving body from the catapult. The deployment system preferably has recoil protection, since the release of the catapult may possibly move the deployment system, because of the mass inertia of the underwater moving body. The recoil protection is preferably in the form of a wedge, a triangular block, an anchor or a hook. The catapult therefore has an attachment apparatus, in particular with a release system, and a stressing apparatus, in particular by means of guide rollers and elastic tension cables.

One special embodiment of the cage has an integral assembly or a multi-part assembly such that bottom area can be separated from the surrounding part. This is advantageous because the underwater moving body can be transported in a secure manner, and can nevertheless be lifted out via the elastic tension cables.

In a further advantageous embodiment of the deployment system, in which the deployment system is not part of the carrier system but is provided separately from it, the carrier system can be positioned in the area of the deployment system, and the deployment system is stationary. This embodiment is advantageous with respect to the transport costs, because the deployment system need not be transported, but the deployment system, which already exists in situ, can be used. Furthermore, the deployment system is weighted down on the ground or is held firmly on the ground, thus achieving physical robustness.

In one alternative embodiment of the deployment system, the carrier system can be positioned in the area of the deployment system, and the deployment system is transportable and, in particular, can be moved longitudinally. The deployment system can therefore be fitted not only to/on the carrier system after transport, but also outside the carrier system. One specific embodiment of the deployment system is therefore transportable and can be moved on land. This is advantageous since a carrier system need not necessarily transport the deployment system and the underwater moving bodies, but the space in the carrier system would thus be usable for a plurality of underwater moving bodies. The deployment system can therefore be transported by a further carrier system. However, the invention is not restricted to deployment by means of a deployment system for a carrier system. In alternative embodiments, one deployment system can be positioned for a plurality of carrier systems. This makes it possible to reduce the number of deployment systems to at most one, thus saving costs.

In one preferred embodiment of the invention, a replenishable container is provided, which provides a counterweight for the deployment system and reduces any tilting torque. For the specific embodiment of the transportable deployment system, there is no need according to the invention to also transport the heavy bulky counterweights to compensate for the weight of the underwater moving body, but only the unfilled container, which can be weighted down by the water in the coastal waterway. As an alternative to the water, the container for the counterweight can also be filled with sand, stones or further heavy materials.

A further embodiment of the deployment system is a lifting/crane device, to which a cable is attached and which is in turn connected to the cage in which the underwater moving body is stored. The underwater moving body can be deployed into the water by lifting, pivoting and/or movement of the cage. Use of a cable for attachment to the cage makes it easier to deploy the underwater moving body into the water since no unlatching apparatus is required and, instead, the underwater moving body can be launched directly from the cage.

One specific embodiment of the deployment system is a lifting/crane apparatus which can be positioned and/or installed on a fixed shore, in particular a quay installation or a rocky coast, and has a crane arm with a range which extends from the water to the carrier system. The range of the lifting/crane apparatus is advantageously designed, by appropriate dimensioning of the crane arm, at least such that the cage together with the underwater moving body can be lifted out of the carrier system and can be deployed into the water without striking the fixed shore. A base for the lifting/crane apparatus can be positioned and made robust by means of one or more weighting-down containers which are filled, in particular, with water. The crane arm can be pivoted on the base of the lifting/crane apparatus by means of a pivoting apparatus. The crane arm can be lengthened by means of a telescopic apparatus. The underwater moving body can be connected directly or indirectly via the cage by means of a cable on the telescopic apparatus. The cassette is fitted to the cage. The communication line of the cassette is connected to a stationary communication-line connecting apparatus via an extension of the communication line, in particular a communication line sheathed in a protective flexible tube. The degrees of freedom of the lifting and crane apparatus allow the underwater moving body to be deployed into the water, wherein the cassette can be connected to the stationary communication-line connecting apparatus in the cage via the extension of the communication line. This allows a connection to be made between the control space and the communication-line connecting apparatus, in this way allowing the underwater moving body to be controlled. The cage can therefore be aligned in a resting horizontal attitude in the water, and the underwater moving body can be launched.

In one alternative embodiment of the lifting/crane apparatus, this apparatus has a stationary base for the lifting/crane apparatus, which is connected to the crane installation. The stationary base for the lifting/crane apparatus consists of at least one post to which a cantilever arm of the lifting/crane apparatus is fitted, in particular via at least one bolt. At least one trolley, and in particular two trolleys, is or are located on the cantilever arm of the lifting/crane apparatus. The second trolley can preferably be connected to a weighting-down container, for the counterweight. The first trolley for the underwater moving body is connected directly by means of a cable to the underwater moving body, or indirectly via the cage. The location of the counterweight on the cantilever arm can advantageously be positioned, and the tilting torque which acts on the cantilever arm as a result of the underwater moving body can be minimized. The cable can be shortened by means of a winch on the trolley for the underwater moving body, thus allowing the cage to be lifted together with the underwater moving body and the cassette. The underwater moving body can be deployed into the water by lifting and moving the trolley for the underwater moving body on the cantilever arm of the lifting/crane apparatus. The trolley for the counterweight can preferably be moved in time with the trolley for the underwater moving body, in order that the cantilever arm compensates for the tilting torque. The communication line of the cassette can be connected by means of the extension of the communication line to the stationary communication-line connecting apparatus, thus allowing the underwater moving body to be controlled.

In a further special embodiment, the deployment system has a lifting/lowering apparatus. The cage is additionally mounted on cage supports on the carrier system, such that a horizontal carrier rail of the lifting/lowering apparatus can advantageously be moved down. The horizontal carrier rail can be moved horizontally on a horizontal rail guide. Analogously to this, a vertical carrier rail can be moved vertically on a vertical rail guide. The vertical carrier rail is connected by means of struts to the horizontal rail guide, in order to fix the structure. This is advantageous since the lifting/lowering apparatus lifts out for loading the cage with the extended horizontal carrier rail, counteracting the lever forces. The vertical rail guide is preferably fitted to a fixed shore, in particular a quay installation or a rocky coast. The retracted horizontal carrier rail is lowered into the water via the vertical carrier rail. This makes it easier to deploy the underwater moving bodies in a controlled manner, since the cage together with the underwater moving body is always aligned horizontally, and it can therefore be launched. This allows the underwater moving body to be deployed from a cage, in the stationary form on land. In the submerged and loaded state, the extension of the communication line can be connected from the cassette to the stationary communication-line connecting apparatus. This allows the underwater moving body to be controlled according to the invention by means of the communication line and the control space.

In one specific embodiment, the carrier system has two or more, in particular the four first-mentioned, deployment systems, specifically firstly the extendable cantilever arm, secondly the sliding device, thirdly the catapult and fourthly the lifting/crane apparatus. This allows the underwater moving bodies to be deployed in coastal waterways selectively, depending on the characteristics of the launching environment. This is advantageous because this embodiment extends the choice of the possible location of the launching environment, thus extending the options for use. The launching apparatus according to the invention therefore preferably envisages the use of the sliding device on stretches of sandy beach, the use of the cantilever arm in the case of quay installations or, in the case of one or more carrier systems, a single lifting/crane apparatus for quay installations or fixed promenades, or the use of the catapult for inaccessible stretches of coast, in particular cliffs with a relatively deep water depth.

In one special embodiment, the cage has attachment means for attachment of a cassette to a communication line which connects the launching apparatus and the underwater moving body, in particular an optical waveguide. Underwater moving bodies are generally connected via a communication line to a control center for controlling the underwater moving body. For this purpose, the communication line is unwound from the underwater moving body, wherein it is normally also unwound from a communication conductor spool on the launch platform, in the case of moving launch platforms. However, since the launching platform remains stationary according to the invention in the water while the underwater moving body is in motion, only one communication conductor spool with a short length is required in the area of the launching apparatus. However, this part of the communication line is accommodated in a cassette, which is advantageously attached to the cage.

Advantageously, the cassette in this case has a spool on which the communication line is wound up, as well as a protective flexible tube for guiding the communication line. The protective flexible tube in this case has a length which corresponds to a multiple of the length of the cage. In this case, a "multiple of the length" should also be understood to mean a non-integer multiple of the length. In this way, the communication line is protected by the protective flexible tube, to be precise over a length which is greater than the length of the cage. The communication line is therefore protected not only in the area of the cage but also in the area of the surf, that is to say also in an area in which wave strikes could possibly damage the communication line if it were to be in the water without protection.

In a further special embodiment, the container is provided with a control space which is equipped with at least one workstation. This control space has control devices for launching and steering the underwater moving body. By way of example, the launching process can be initiated via this control space. Furthermore, for example, a mission of the underwater moving body can also be terminated, if this were to be necessary, from this control space.

In one specific embodiment, the control space is separated from the space which holds the underwater moving body by means of a partition wall, which preferably has a door. This partition wall advantageously has a projection in the direction of the control space in the area of the underwater moving body. This increases the maximum length of an underwater moving body which is accommodated in the container. This allows one or more additional battery sections to be added to an underwater moving body. This is advantageous since this makes it possible to increase its range.

In a further embodiment, the deployment system is modular and has a plurality of modules which can be detachably connected to one another and can be reconnected to one another. The deployment system can therefore be separated into a plurality of relatively small modules, and each module can also be transported individually. This is advantageous because this reduces the probability of the deployment system being identified while being transported. The deployment system can therefore be transported in a concealed and inconspicuous manner. The modules can therefore be connected to one another again in situ, for example in the launching environment, and can be used as an entire deployment system.

Further advantageous embodiments will become evident from the dependent claims and from the exemplary embodiments which are explained with reference to the attached drawing, in which:

Figure 16:
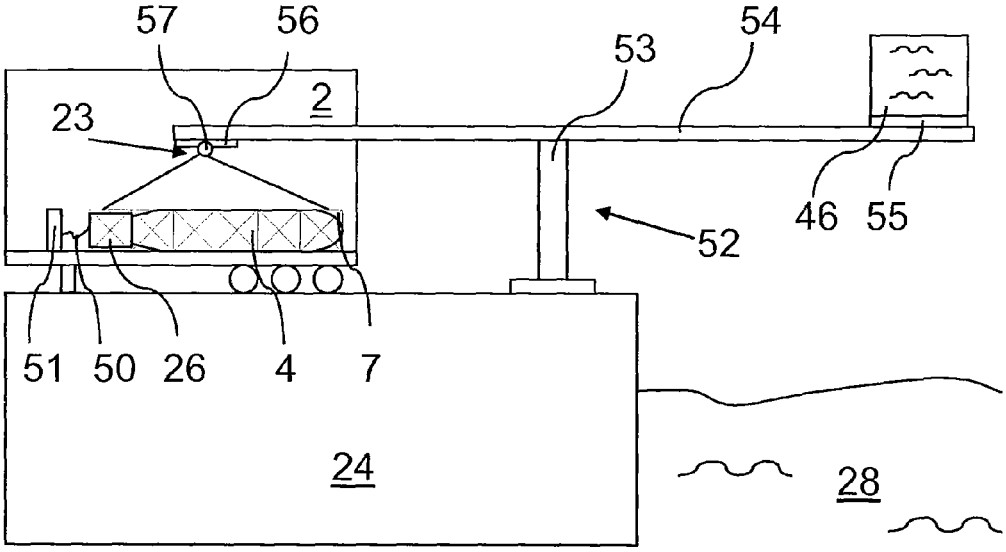
Figure 17:
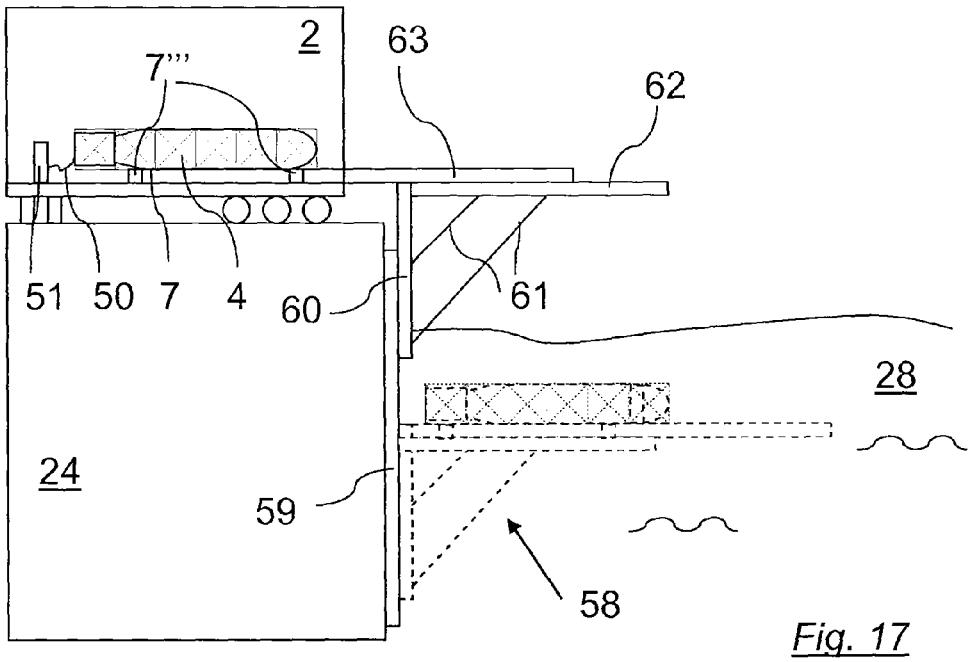

FIG. 16 shows a launching apparatus according to a fifth exemplary embodiment of the invention, in the form of a side view with a further lifting/crane apparatus with a counterweight on the cantilever arm; and FIG. 17 shows a launching apparatus according to a sixth exemplary embodiment of the invention, in the form of a side view with a lifting/lowering apparatus for loading, and by dashed lines, during deployment of the underwater moving body in the water.

Figure 1:
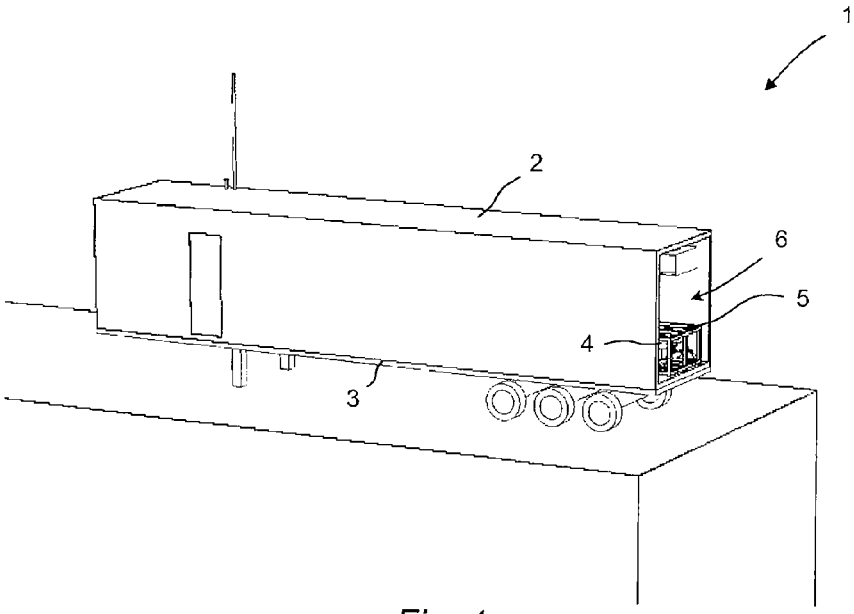
FIG. 1 shows a launching apparatus for launching an underwater moving body from a container according to one exemplary embodiment of the invention, in the form of a perspective view essentially from the side at the rear.

FIG. 1 shows a launching apparatus 1 which comprises a container 2 which is mounted on a trailer 3. The trailer is used as a trailer for a towing vehicle. The towing vehicle together with the trailer 3 and the container 2 act as a land vehicle for transporting one or more underwater moving bodies 4, 5 within the container 2.

All the FIGS. 1 to 8 show the container 2 with a tailgate or rear doors which are not illustrated but are used to close an opening 6 at the rear of the container 2.

Figure 2:
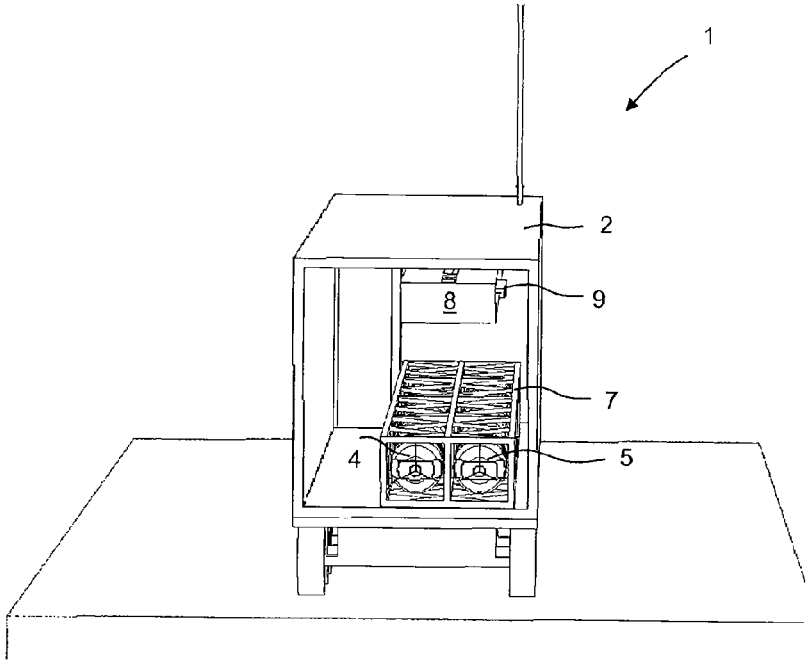
FIG. 2 shows the launching apparatus as shown in FIG. 1, in the form of a perspective view essentially from the rear.

FIG. 2 shows the launching apparatus as shown in FIG. 1, in the form of a perspective rear view. Two underwater moving bodies 4, 5 are located within the container. The underwater moving bodies are aligned in the container 2 such that their respective head section is located in the rear area of the container, while the opposite drive section is located in the front area of the container.

The underwater moving bodies 4, 5 are held in one or more cages 7 wherein, in the illustrated exemplary embodiment, the cage 7 is in the form of a double cage for holding two underwater moving bodies. Only one double cage 7 is illustrated within the container 2 in the figures. However, a plurality of individual or double cages may also be stacked one above the other within one container.

The cage 7 is in the form of a grid frame, as a result of which it sinks directly when immersed in water, without air bubbles being able to form in spaces that are blocked at the top within the cage. That is to say, the cage is open on all sides, such that water can flow into the cage interior from all sides when the cage is submerged.

A cantilever arm 8, which can be extended from the container 2 and can be extended horizontally from the rear opening 6 in the container 2, is located above the cage 7.

Furthermore, a trolley 9 is located on the cantilever arm 8 and can be moved along the cantilever arm 8, in particular from an area essentially above the center or the center of gravity 7 of the cage together with the underwater moving bodies 4, 5 to the outermost end which can be moved to on the cantilever arm 8. The trolley 9 is fitted with a cable, by means of which the cage 7 can be raised and lowered. The cable is advantageously passed over a guide roller, which is arranged on the trolley 9, to a drive device which is provided in the front area of the container 2, by means of which drive device the cable can be moved out and in. The drive device is advantageously arranged in the front area of the container 2, in order to form a counterweight by virtue of its weight, which is required to lift loads weighing tonnes.

In the context of the invention, the term "cables" should be understood in the wider sense, and also includes lifting devices such as lifting straps or chains, in particular ball chains, ring chains, roller chains or web chains.

The cantilever arm 8 and the trolley 9 are used for loading and unloading the container 2, to be precise in particular for loading/unloading the cage 7 and/or the underwater moving bodies 4, 5 into/out of the container 2, and for deploying the cage 7 and/or the underwater moving bodies 4, 5 into a waterway.

Figure 3:
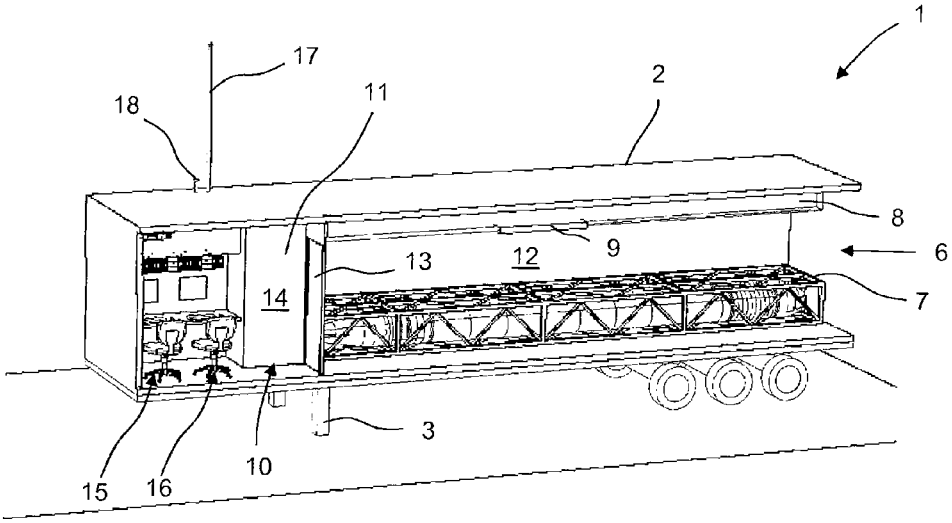
FIG. 3 shows the launching apparatus as shown in FIG. 1, in the form of a perspective section view essentially from the side at the front.

FIG. 3 shows a control space 10 in the front area of the container 2, that is to say in that area which is opposite the rear opening 6, which control space 10 is separated by means of a partition wall 11 from the transport space 12, which holds the underwater moving bodies 4, 5. There is a door 13 within the partition wall 11, providing access from the control space 10 to the transport space 12.

The partition wall 11 has at least one projection 14, in whose area the length of the control space 10 is reduced. At the same time, however, the corresponding length of the transport space 12 is lengthened in this area. The cage 7 is therefore arranged in the area of the projection 14. This results in optimum spatial utilization of the container 2. This means that underwater moving bodies of maximum length can be accommodated in the container without unnecessarily constricting the control space 10 in the process and specifically because that area of the transport space 12 alongside the projection 14 is added to the control space 10, and can therefore be used as a wardrobe area, etc. by the control personnel in the control space 10.

Two workstations 15, 16 with screens, keyboards and seats are provided in the control space 10. These workstations are used as an interface for control systems for the underwater moving bodies 4 and 5, which control systems are likewise accommodated in the control space 10.

The control space is connected by radio to a mobile or stationary control center via an extendable antenna 17 which is fitted in the container 2. The antenna 17 is therefore used to interchange data with a higher-level unit.

The container 2 furthermore has a further extendable antenna 18, which detects the current geographic position of the launching apparatus 1, as a GPS (Global Positioning System) antenna, together with a GPS receiver.

Furthermore, air conditioning devices and/or heaters and the like are located in the area of the control space 10, in order to provide safe climatic conditions for people and for the technical devices accommodated within the container 2.

Figure 4:
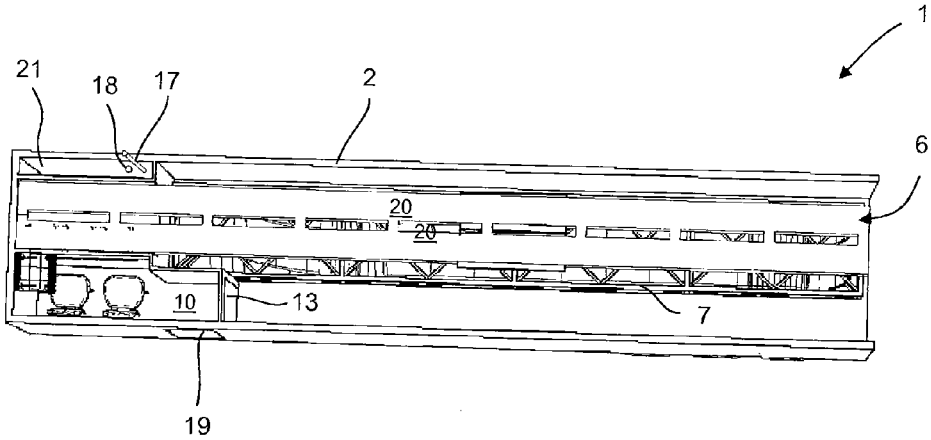
FIG. 4 shows the launching apparatus from FIG. 1, in the form of a perspective section view essentially from above.

FIG. 4 shows the launching apparatus 1 in the form of a section view from above. The confined conditions in the control space 10 can be seen clearly, and these are made less stringent, to a certain extent, by the continuation of the control space 10 to the door 13. A further door 19 is located in this area, through which the control space 10 can be entered.

A guide rail 20 on which the cantilever arm 8 is guided and held is located above the cage 7. A counterweight (which is not illustrated) is provided on the opposite end area of the guide rail 20 to the rear opening 6 and prevents the container 2 from tilting when the cantilever arm 8 and the trolley 9 are extended, with the cage 7 attached thereto and containing underwater moving bodies 4, 5. An appliance space 21, in which further appliances, such as radios, are accommodated, is located in the area of the antennas 17, 18.

Figure 5:
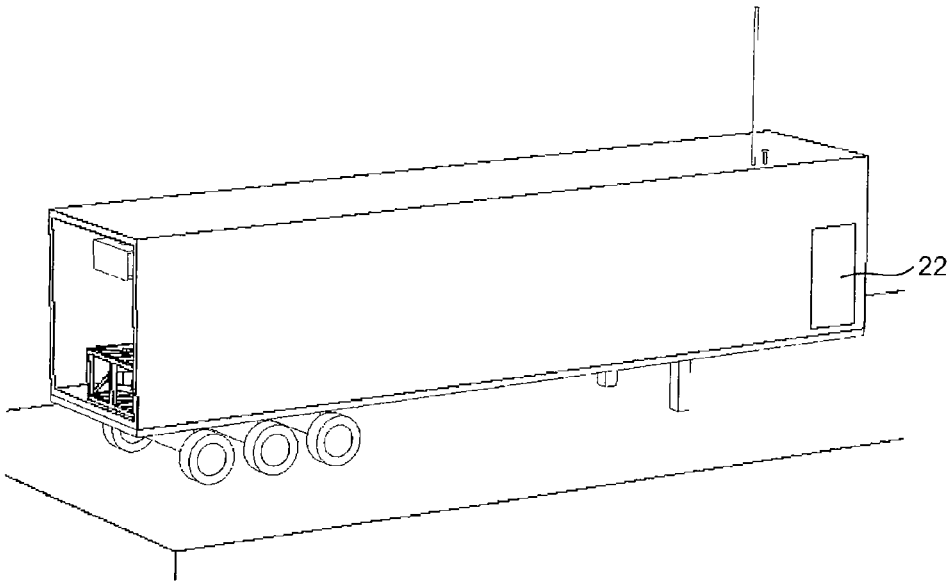
FIG. 5 shows the launching apparatus as shown in FIG. 1, in the form of a further perspective view from the side at the rear.

As can be seen from FIG. 5, this appliance space 21 is accessible via its own door 22.

Figure 6:
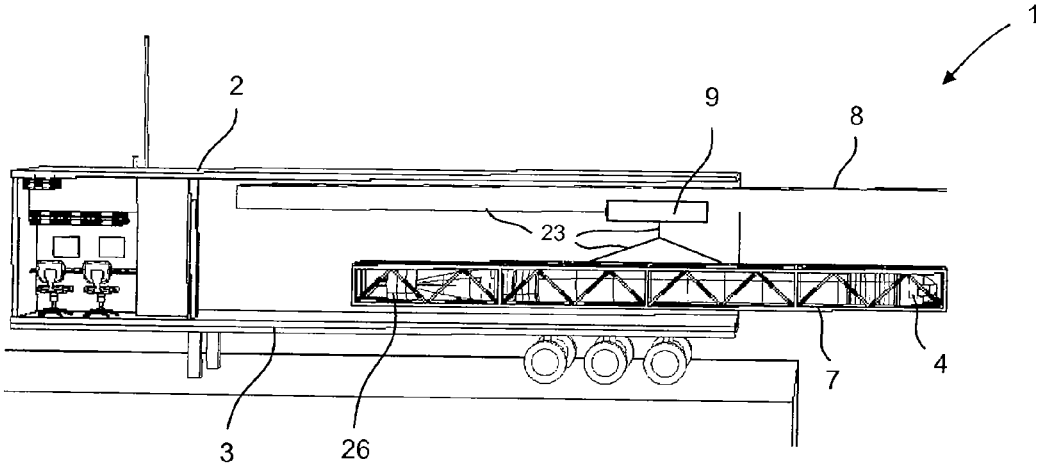
FIG. 6 shows the launching apparatus as shown in FIG. 1, in the form of a perspective section view essentially from the side, with the cantilever arm partially extended.

FIG. 6 shows the cage 7 during the process of deploying the underwater moving bodies 4, 5 into the water. The cage 7 is in a state in which it is raised above the floor of the container 2. In this case, the cage 7 is held by means of a cable 23, which is guided via the trolley 9. Both the cantilever arm 8 and the trolley 9 have already been moved somewhat out of the container 2, such that the cage 7 together with underwater moving bodies 4, 5 has also been moved by a corresponding amount out of the container 2.

Figure 7:
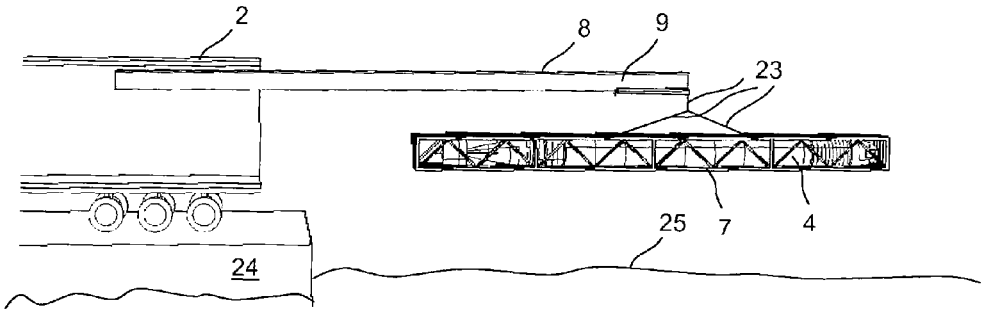
FIG. 7 shows the launching apparatus as shown in FIG. 6, with the cantilever arm completely extended and the trolley extended.

FIG. 7 shows the cantilever arm 8 and the trolley 9 in their state in which they have each been moved completely out of the container 2. In this state, the cage 7 together with the underwater moving bodies are located completely outside the container, to be precise already at such a distance from the container 2 that the cage is located completely outside, for example, a quay installation 24, and therefore completely above the water surface 25.

Figure 8:
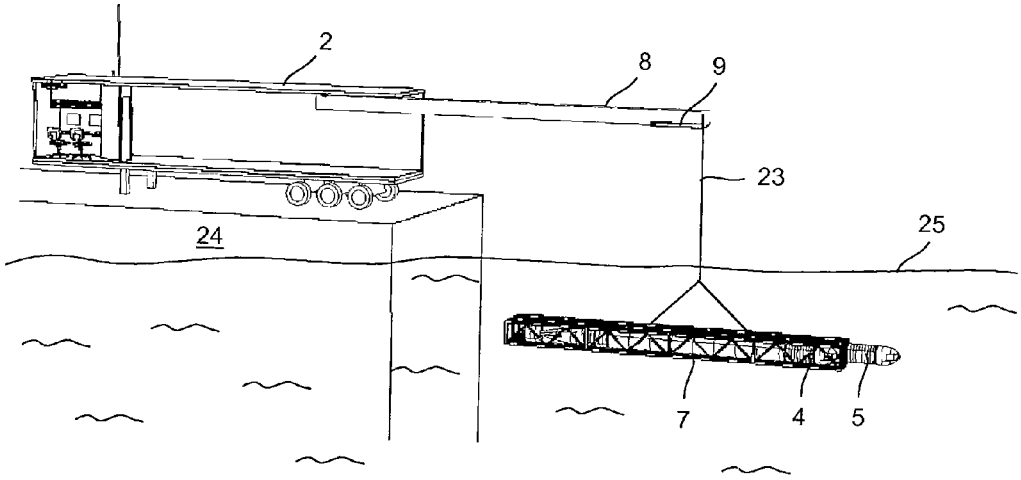
FIG. 8 shows the launching apparatus as shown in FIG. 7, with an underwater moving body which has been deployed into the water.

FIG. 8 shows the cage 7 in the immersed state, that is to say already below the water's surface 25. For this purpose, the cable 23 has been unwound from a winch to such an extent that the cage 7 is completely immersed in the water. The underwater moving bodies 4, 5 can be launched from this position. FIG. 8 shows the underwater moving body 5 during the launching process, with its head section already being located outside the cage 7.

Because of the open design of the cage 7, the underwater moving body 5 which is being launched does not produce any significant recoil in or on the cage 7, which could lead to a change in the position of the cage 7. The further underwater moving body 4 can therefore also be launched in a brief time sequence, or else substantially at the same time.

In the present context, underwater moving bodies 4 may be any underwater moving bodies which have their own drive. In particular, these are drones for mine hunting and/or destruction, (heavyweight) torpedoes or autonomous underwater vehicles.

The underwater moving bodies 4, 5 are connected throughout their use, or at least during a wide proportion of use, via a communication line (which is not illustrated) to the controllers which are provided in the control space 10. For this purpose, a communication line is located within the underwater moving body 4, 5 and is wound up on a spool there, for example an optical waveguide. This communication line is connected via an appropriate connection to a further spool, which is accommodated in a cassette 26 (FIG. 6) provided outside the underwater moving body. The cassette is fitted to the cage 7, and is connected to the control space 10 via a robust cable. The cassette 26 remains on the cage 7 after the underwater moving body 4 has been launched. The cassette 7 contains a protective flexible tube, which protects the communication line against touching the bottom and against wave strikes. The protective flexible tube has a length in order to guide the communication line safely in relatively calm waterways further away from the shore. The communication line is located freely in the water at the end of the protective flexible tube and is unwound further from the spool that is located in the underwater moving body 4 as this underwater moving body 4 moves away, as a result of which the communication line which has been unwound is located in a substantially stationary form in the water.

Figure 9:
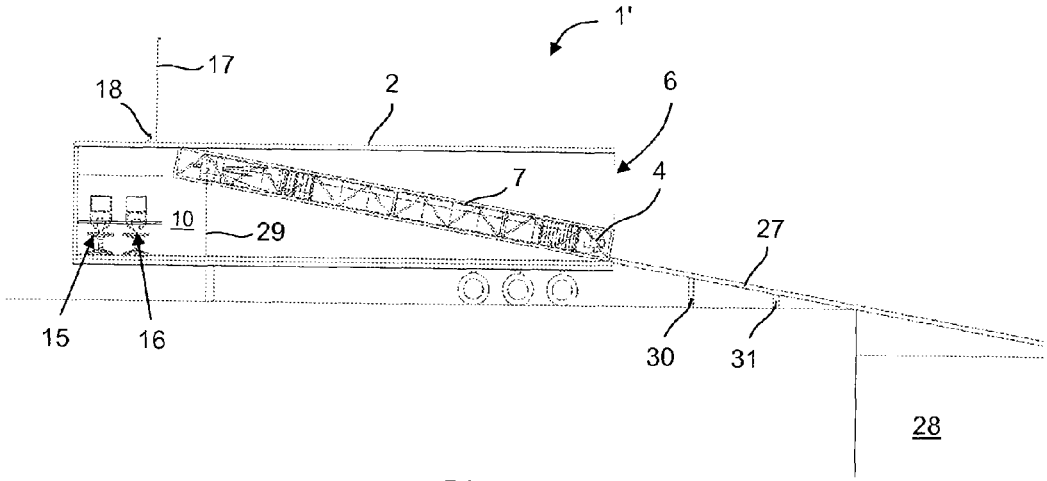
FIG. 9 shows a launching apparatus according to a second exemplary embodiment of the invention, having a sliding device, in the form of a side section view.

FIG. 9 shows an alternative exemplary embodiment of the invention having a launching apparatus 1' which is likewise accommodated in a container 2. The container 2 corresponds to the container illustrated in FIGS. 1 to 8, although it does not have a cantilever arm or a trolley in the illustrated exemplary embodiment. However, the container 2 likewise contains a control space 10, workstations 15, 16 and antennas 17, 18. Furthermore, a cage 7 with one or more underwater moving bodies 4 is once again provided in the container.

However, in the exemplary embodiment shown in FIGS. 9 to 12, the cage 7 is not itself deployed from the container into the water when the underwater moving body 4 is deployed into the water, but remains in the container 2. A sliding path 27 is provided in the area of the rear opening 6 in the container 2 and is connected directly to the cage 7, in particular to its lower frame. The sliding path 27 opens into the water 28.

Figure 10:
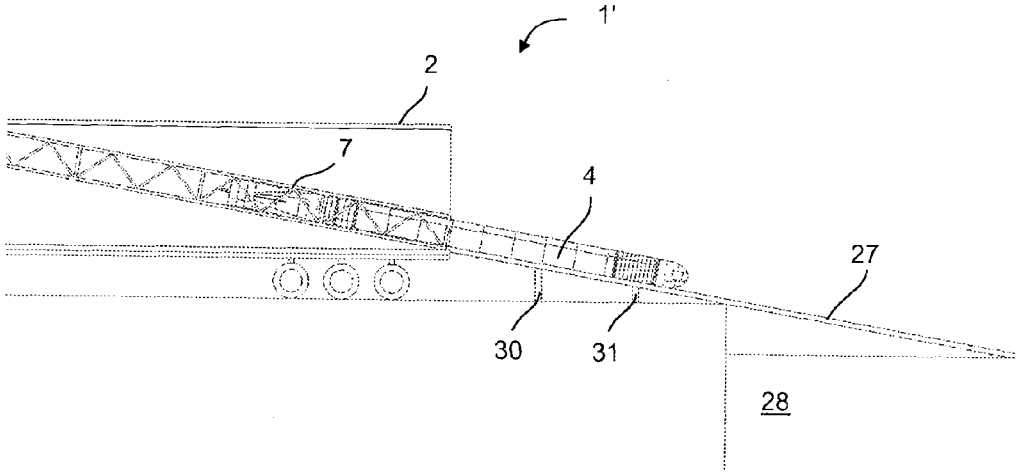
FIG. 10 shows the launching apparatus from FIG. 9, with the underwater moving body having already been partially moved out.
Figure 11:
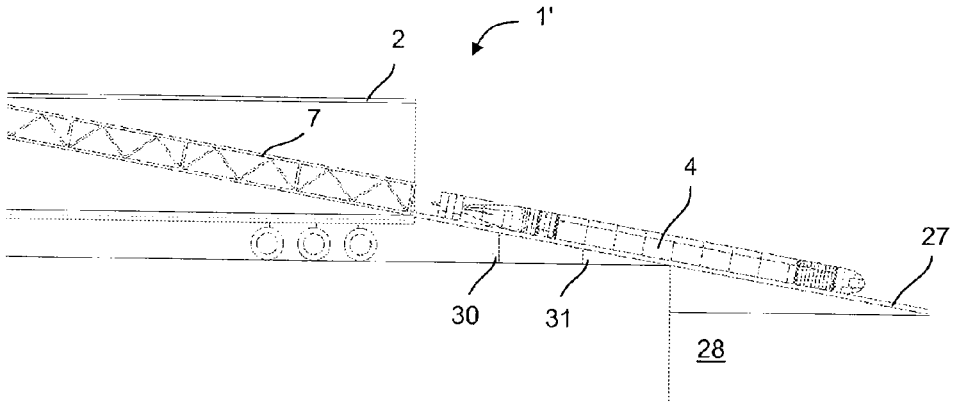
FIG. 11 shows the launching apparatus as shown in FIG. 9, with the underwater moving body having been completely moved out.
Figure 12:
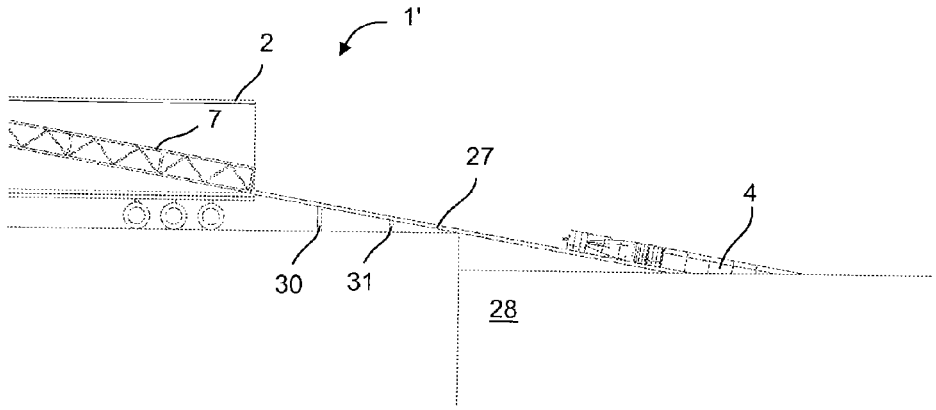
FIG. 12 shows the launching apparatus as shown in FIG. 9, with the underwater moving body already partially submerged in the water.

In order to launch the underwater moving body 4, the cage 7 is raised in its end area opposite the rear opening 6 along a guide device 29, for example a guide rod, until the underwater moving body moves out of the cage 7 onto the sliding path 27, as is illustrated in FIGS. 10 to 12.

FIG. 10 shows the underwater moving body 4 when more than half of it has already moved out of the cage 7.

FIG. 11 shows the underwater moving body 4 when it has already moved completely out of the cage 7 and the container 2.

FIG. 12 shows the underwater moving body 4 when it is already largely immersed in the water 28.

According to the second exemplary embodiment shown in FIGS. 9 to 12, the cage 7 may likewise be in the form of a double cage, as has been described in conjunction with FIGS. 1 to 8. However, alternatively, it may also be designed as a single cage. However, if the cage 7 is in the form of a double cage, it is advantageous for the sliding path 27 to be in the form of a double path. However, alternatively, the sliding path 27 may also be a single path in this case.

The sliding path 27 is advantageously supported by supports 30, 31 with respect to the ground. Furthermore, the sliding path 27 is preferably formed in segments, such that a plurality of sliding path segments can be fitted to one another in order to lengthen the overall length of the sliding path 27. This is advantageous in order to guide the sliding path 27 into a water area with an adequate water depth.

Figure 13:
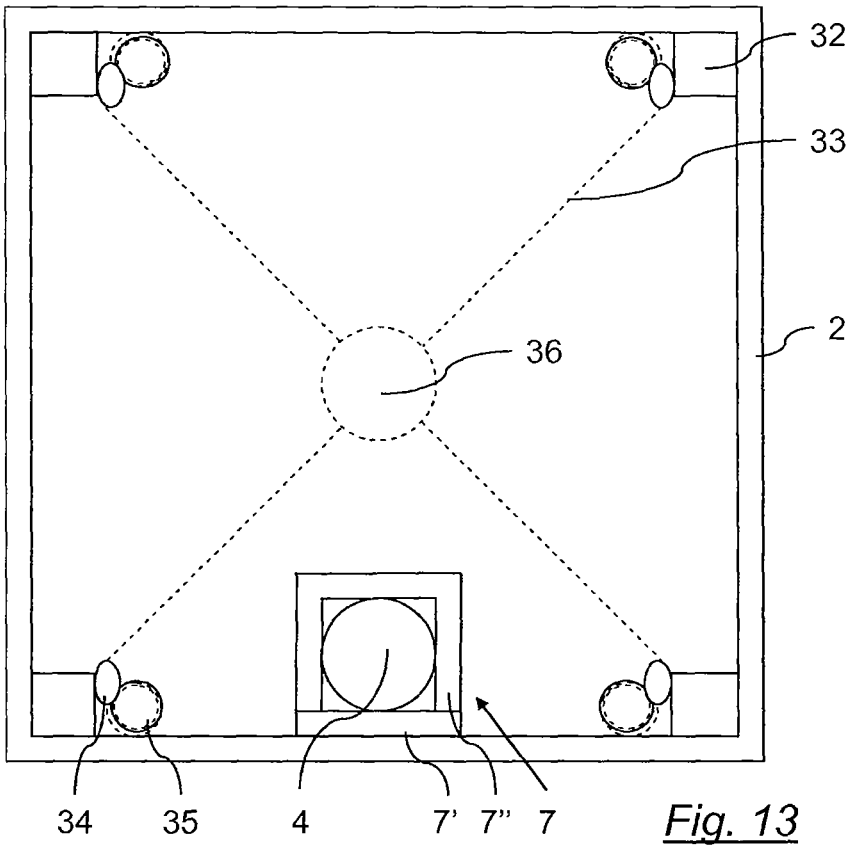
FIG. 13 shows a launching apparatus according to a third exemplary embodiment of the invention, with a catapult, in the form of a view from the rear.

FIG. 13 shows the container 2 in which the cage 7 is stored with the underwater moving body 4, as well as rails 32 which are fitted to the container 2. One special embodiment of the cage 7 has a two-part or multi-part design, such that a base area 7' can be disconnected from a surrounding part 7", in particular after transport of the cage, is designed such that only the part 7' of the cage is still present. From this position, the underwater moving body 4 can be lifted out of the part 7' of the cage by means of elastic tension cables 33. The tension cables 33 are connected to the rails 32. The tension cables 33 are stressed either by movement of guide rollers 34 in or on the rails or by shortening the tension cable 33 by means of a winch 35, as a result of which the underwater moving body 4 reaches a position 36 shown by dashed lines. The underwater moving body 4 is therefore located in the prestressed initial position of the catapult.

Figure 14:
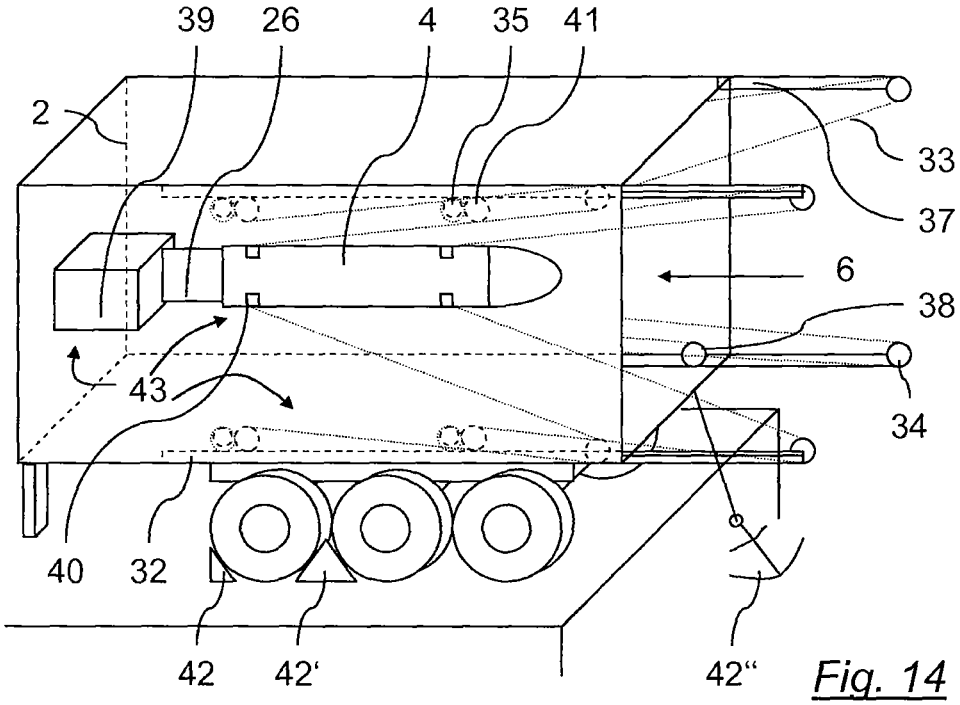
FIG. 14 shows the launching apparatus as shown in FIG. 13, in the form of a perspective section view essentially from the side, with telescopic rails extended.

FIG. 14 shows the stressed catapult as shown in FIG. 13 with two elastic cables 33 for each rail 32, and additionally with extensions of the rails 32 with the aid of a telescopic rail 37. At its end facing the rear opening 6, the telescopic rail 37 has the guide roller 34, as well as a second guide roller 38 at a further point on the rail 37. Attachments for the tension cables, in particular for the winch 35, are fitted at a corresponding manner to the guide rollers 34, 38 in the container 2. An attachment apparatus for the cassette 39 is connected to the container 2. The underwater moving body 4 is connected via the cassette 26 to the attachment apparatus for the cassette 39, which has a release system. The underwater moving body 4 has a holder 40 for each tension cable 33. The holder 40 is designed such that the tension cable 33 is released as soon as it is located in the opposite direction to the stressed pulling direction. The holder 40 cannot be seen when the tension cable 33 is not connected, because of a spring-operated flap. The elastic tension cable 33 is therefore connected from a guide roller 41 to the winch 35 via the guide roller 34, or via the guide roller 38 to the underwater moving body 4 indirectly via the holder 40. The container 2 has a return protection means 42, 42', 42". The return protection means 42 is in the form of a wedge, which blocks the tires of the articulated trailer in one direction, specifically the return direction. The return protection means 42' is a triangular block, which blocks one or two tires in longitudinal directions at the same time. The return protection means 42" is an anchor which connects the carrier system, in particular the container 2, to the ground. The catapult can be released in the stressed state by a release system on the attachment apparatus, via the attachment apparatus for the cassette 39. The release system is controllable with respect to the connection of the underwater moving body 4 to the attachment apparatus of the cassette 39, and has an apparatus for controlled separation, in particular an electrically controllable hook system. The catapult 43 therefore has an attachment apparatus with a release system 39, a stressing apparatus, in particular by means of the guide rollers 34, 38 and elastic tension cables 33.

Figure 15:
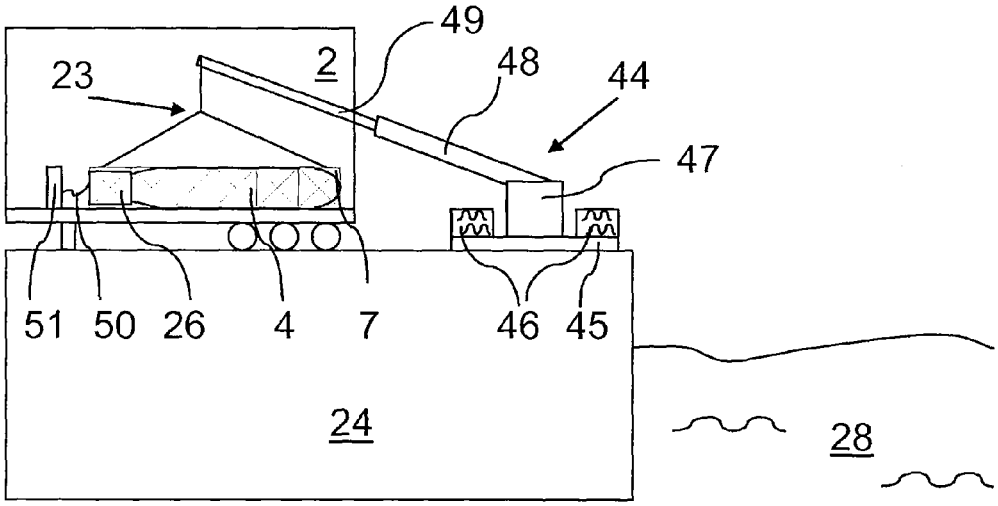
FIG. 15 shows a launching apparatus according to a fourth exemplary embodiment of the invention, in the form of a side view with a lifting/crane apparatus.

FIG. 15 shows a lifting/crane apparatus 44 which is positioned on the quay installation 24. The range of the lifting/crane apparatus 44 is designed to be at least sufficiently great that the cage 7 together with the underwater moving body 4 can be lifted out of the container 2 and can be deployed into the water 28, without striking the quay installation 24. A base of the lifting/crane apparatus 45 can be positioned and stabilized on the quay installation 24 by means of weighting-down containers 46 which, in particular, are filled with water. A crane arm 48 can be pivoted on the base of the lifting/crane apparatus 45 by means of a pivoting apparatus 47. The crane arm 48 can be lengthened by a telescopic apparatus 49. The underwater moving body 4 can be connected directly or indirectly via the cage 7 to the telescopic apparatus 49 by means of the cable 23. The cassette 26 is fitted to the cage 7. The communication line of the cassette 26 can be connected via an extension of the communication line 50, in particular a communication line sheathed by a protective flexible tube, to a stationary communication-line connecting apparatus 51. Because of the degrees of freedom of the lifting and crane apparatus 44, the underwater moving body 4 can be deployed into the water 28, in which case the cassette 26 can be connected to the stationary communication-line connecting apparatus 51 in the cage 7, via the extension of the communication line 50.

FIG. 16 shows a further exemplary embodiment of the lifting/crane apparatus 52. The stationary base of the lifting/crane apparatus 53 is connected to the quay installation 24. The stationary base of the lifting/crane apparatus 53 consists of at least one, in particular movable, post, on which a cantilever arm of the lifting/crane apparatus 54 is fitted via at least one bolt. Two trolleys are located on the cantilever arm of the lifting/crane apparatus 54. The trolley for the counterweight 55 can be connected to a weighting-down container 46. The trolley for the underwater moving body 56 is connected by means of the cable 23 directly to the underwater moving body 4, or is connected indirectly via the cage 7. The cable 23 can be shortened by means of a winch 57 on the trolley for the underwater moving body 56, thus making it possible to lift the cage 7 together with the underwater moving body 4 and the cassette 26. The underwater moving body 4 can be deployed into the water 28 by moving the trolley for the underwater moving body 56 on the cantilever arm of the lifting/crane apparatus 54. The trolley for the counterweight 55 can be moved in time with the trolley for the underwater moving body 56, thus preventing the lifting/crane apparatus from tilting. The communication line of the cassette 26 can be connected to the stationary communication-line connecting apparatus 51 by means of the extension of the communication line 50.

FIG. 17 shows a lifting/lowering apparatus 58 in two states. Dashed lines illustrate the lifting/lowering apparatus 58 in the lowered and loaded state in the water 28. Solid lines illustrate the lifting/lowering apparatus 58 in the state during loading. The lifting/lowering apparatus 58 consists, inter alia, of the vertical rail guide 59, which is fitted to the quay installation 24. The vertical carrier rail 60 is fitted to the vertical rail guide 59 and allows the height of the lifting/lowering apparatus to be adjusted. The vertical carrier rail 60 is connected to the horizontal rail guide 62 by struts 61. The horizontal carrier rail 63 is guided on the horizontal rail guide 62. The cage 7 is mounted on the container 2 via cage supports 7''', such that the horizontal carrier rail 63 can be moved under the cage 7. The underwater moving body 4 can therefore be deployed into the water 28 in the cage 7 on the horizontal retracted carrier rail 63 by means of the vertical carrier rail. The extension of the communication line from the cassette to the stationary communication-line connecting apparatus is not illustrated in the lowered and loaded state, for clarity reasons. Nevertheless, the communication line can be connected to the communication line in the connecting apparatus, as already described.

All of the features mentioned in the above description and in the claims can be used both individually and in any desired combination with one another according to the invention. The invention is therefore not restricted to the described and claimed feature combinations. In fact, all combinations of individual features should be considered as having been disclosed.

The invention claimed is:

1. A launching apparatus for launching an underwater moving body (4, 5) comprising:

a land-based carrier system (2) for transporting the underwater moving body (4, 5), and a deployment system (8; 27; 43; 44; 52; 58) for land-based deployment of the underwater moving body (4, 5) into a coastal waterway (25, 28), wherein the deployment system (8; 44; 52; 58) has a cage (7) for holding the underwater body (4,5), the cage (7) has struts which surround the underwater moving body and the cage can be lowered into the coastal waterway, and the underwater moving body (4, 5) can be launched from this cage (7).

2. The launching apparatus as claimed in claim 1, wherein the carrier system is one of:

a) a land-based vehicle having a container, b) a land-based vehicle having a cover, c) a land-based vehicle having a tarpaulin, d) a land-based vehicle having one or more connected trailers with containers, e) a rail vehicle.

3. The launching apparatus according to claim 1, wherein the carrier system has a visually deceiving camouflage device, chosen from: a visual dune simulation, a desert sand simulation or a camouflage cover.

4. The launching apparatus according to claim 1, wherein the deployment system has a cantilever arm (8) which can be extended from the carrier system, a trolley (9) and a cable (23), wherein the trolley (9) can be moved on the cantilever arm (8) and the cable (23) can be connected at a first of its two ends to the underwater moving body (4, 5) or cage (7) and is guided via the trolley (9), and is connected by its second end to a drive by means of which, when the cantilever arm (8) is extended and the trolley (9) has been moved to an outer limit position on the cantilever arm (8), the underwater moving body (4, 5) can be let into the water.

5. The launching apparatus according to claim 4, wherein the first end of the cable (23) can be connected to the cage (7).

6. The launching apparatus according to claim 4, wherein the cantilever arm (8) is a telescopic cantilever arm having a plurality of telescopic segments and the land-based carrier system (2) has a closeable opening (6) and has a counterweight arranged in the area of that end of the carrier system (2) which is opposite the closeable opening (6), out of which the cantilever arm (8) can be moved.

7. The launching apparatus according to claim 1, wherein the land-based carrier system (2) includes a closable opening (6), a drive and a pivotable shaft, and wherein the cage (7) can be pivoted to a vertical plane by means of the drive about the pivoting shaft which is fitted in an area of the container opening (6).

8. The launching apparatus according to claim 4, wherein the cage (7) has attachment means for attaching a cassette, which has a communication line which connects the launching apparatus and the underwater moving body (4, 5), wherein the cassette has a spool on which the communication line is wound up, as well as a protective flexible tube for guiding the communication line, with a length which corresponds to a multiple of the length of the cage (7).

9. The launching apparatus according to claim 1, wherein the carrier system has a closeable opening (6), and the deployment system has a sliding device (27) which can be lengthened starting under an underwater moving body (4, 5), which is connected to the cage (7) and which holds the underwater moving body (4, 5) extending or inclined downward, via a closable opening (6) of the carrier system.

10. The launching apparatus according to claim 1, said launching apparatus further comprising catapult (43) for firing the underwater moving body (4, 5) out of the carrier system, wherein the catapult (43) comprises a spring system having stressable elastic cables.

11. The launching apparatus according to claim 1, wherein the deployment system includes:

a lifting apparatus (44, 52) in an area of the carrier system, for allowing the underwater moving body (4, 5) to be deployed into the water (25, 28) from the carrier system, by lifting, pivoting and movement by means of a cable (23) and the cage (7), or a lowering apparatus (58) in an area of the carrier system, for deploying the underwater moving body (4, 5) with the cage (7) into the water, said lowering apparatus having vertical and horizontal guide rails (59,62) and horizontal and vertical carrier rails (60, 63) which are guided in rail guides (59, 62), wherein the vertical rail guide (59) can be fitted to a fixed shore.

12. The launching apparatus according to claim 1, wherein the container (2) has a control space (10) equipped with at least one workstation (15, 16) and has devices for launching and controlling the underwater moving body (4, 5).

13. A method for launching an underwater moving body (4, 5) using the launching apparatus according to claim 1, said method comprising transporting the underwater moving body (4, 5) to a launch position in said land-based carrier system (2); and deploying said underwater moving body (4, 5) from the land by means of the deployment system (8; 27; 43; 44; 52; 58) into a coastal waterway from this carrier system (2), and launching said underwater moving body (4, 5) from the launch position, wherein the method comprises one of the following steps a) and b):

a) the carrier system (2) having the deployment system (8; 27; 43) is moved on land to the launch position, wherein the underwater moving body (4, 5) is moved out of the carrier system (2) by means of a cable (23) which is guided via a trolley (9) which can be moved on a cantilever arm (8) which can be moved out, is let into the water above the waterway (25, 28), and is then launched; or b) the deployment system (8; 44; 52; 58) has a cage (7) having struts which surround the underwater moving body within the cage (7) or has a tubular container in which the underwater moving body (4, 5) is held, in which the underwater moving body (4, 5) is let into the coastal waterway, and from which the underwater moving body (4, 5) is launched, wherein the underwater moving body (4, 5) is moved out of the container (2) by means of a cable (23) which is guided via a trolley (9) which can be moved on a cantilever arm (8) which can be moved out, is let into the water above the waterway (25, 28), and is then launched.

* * * * *